US006217708B1

(12) United States Patent
Kurihara et al.

(10) Patent No.: US 6,217,708 B1
(45) **Date of Patent: *Apr. 17, 2001**

(54) DOUBLE-SIDE AND FULL COLOR TRANSFER PAPER FOR ELECTROPHOTOGRAPHY

(75) Inventors: Tsutomu Kurihara, Ebina; Katsumi Harada, Ashigara; Masaru Kato; Harumi Watanabe, both of Tokyo, all of (JP)

(73) Assignees: Fuji Xerox Co., Ltd.; Oji Paper Co., Ltd., both of Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/826,818

(22) Filed: Apr. 8, 1997

(30) Foreign Application Priority Data

Apr. 9, 1996 (JP) ..... 8-086306

(51) Int. Cl.[7] ..... D21F 27/14

(52) U.S. Cl. ..... 162/113; 162/125; 162/201; 428/211; 428/409; 428/537.5

(58) Field of Search ..... 162/252, 259, 162/263, 336, 343, 198, 201, 131, 125; 428/211, 409, 537.5

(56) References Cited

U.S. PATENT DOCUMENTS 5,637,383 * 6/1997 Sakurai et al. ..... 428/211

FOREIGN PATENT DOCUMENTS

| | | |
|---|---|---|
| 1-292354 | 11/1989 | (JP) . |
| 4-268567 | 9/1992 | (JP) . |
| 4-291351 | 10/1992 | (JP) . |
| 4-337736 | 11/1992 | (JP) . |
| 4-349468 | 12/1992 | (JP) . |
| 5-53363 | 3/1993 | (JP) . |
| 5-341553 | 12/1993 | (JP) . |
| 6-186769 | 7/1994 | (JP) . |

OTHER PUBLICATIONS

James P. Casey, Pulp and Paper Chemistry and Chemical Technology, 3rd ed. (John Wiley & Sons, Inc.), 1039, 1734, 1980.*

* cited by examiner

*Primary Examiner*—Peter Chin
(74) *Attorney, Agent, or Firm*—Oliff & Berridge, PLC

(57) ABSTRACT

A double-side and full color transfer paper for electrophotography having a paper layer divided into a felt side and a wire side, wherein the difference between the orientation of fiber in the felt side and that in the wire side of the paper layer is 0.1 to −0.1, and both of residual curvature of the transfer paper in a MD (in a movement direction of a paper machine) and that in a CD (in a direction perpendicular to the MD) are included in a range from 7 to −7 $m^{-1}$ and the expansion ratio of the transfer paper in the CD is 0.55 or lower, if necessary.

4 Claims, 2 Drawing Sheets

DOUBLE-SIDE AND FULL COLOR TRANSFER PAPER FOR ELECTROPHOTOGRAPHY

BACKGROUND OF THE INVENTION

1. Field of the Invention

The present invention relates to a double-side and full color transfer paper for electrophotography having an improved traveling characteristic in an electrophotographic copying machine or a printer when a double-side copying operation is performed.

2. Description of the Related Art

Copying machines, printers and facsimile machines using the electrophotography are structured such that a charge pattern is formed on the surface of a photosensitive drum or a photosensitive belt containing amorphous silicon, an organic semiconductor and so forth to form a toner image by causing toner particles to adhere to the charge pattern. Then, transfer paper is brought into contact with the photosensitive surface to perform corona discharge or the like from the wire side of the paper so as to transfer the toner image to the transfer paper and fix the same with heat, pressure or the like to obtain a printed image.

Since the foregoing full color copying method uses toner in four colors, its transference mechanism is considerably different from that of the conventional white and black copying machine. It is important for the full color copying machine to accurately superimpose and transfer four color toner images. Therefore, -a transfer drum method has been employed which is arranged such that a transfer member, such as transfer paper, is supported on a transfer-member holding member, typified by a transfer drum, which is rotated in synchronization with a toner-image carrier, such as a photosensitive drum, and a toner image is transferred to the transfer paper supported around the transfer drum.

To improve productivity of the copying operation, a tandem method of forming a color image is employed by a portion of apparatuses, the method being structured such that a transference-member holding member in the form of an endless belt is employed and a plurality of image forming means corresponding to the colors are disposed along a direction in which the transference-member holding member is moved so as to sequentially transfer toner images in the respective colors on the transfer member held by the transfer-member holding member.

As described above, the transference mechanism and the like of the color copying machine are considerably different from those of the white and black copying machine. Therefore, considerably different characteristics are required for the transfer paper. Since there arise a variety of requirements in that the quality of the formed image must be improved and the state of curled paper must be stabilized, various improving means have been suggested (for example, refer to Japanese Patent Laid-Open No. 1-292354, Japanese Patent Laid-Open No. 4-268567, Japanese Patent Laid-Open No. 4-291351, Japanese Patent Laid-Open No. 4-337736, Japanese Patent Laid-Open No. 4-349468, Japanese Patent Laid-Open No. 5-341553, Japanese Patent Laid- Open No. 5-53363 and so forth).

In recent years, many color copying machines have a double-side mechanism. Thus, means for improving requirements for the double-side copy to satisfy, for example, prevention of set-off and improvement in the quality of the formed image have been suggested (refer to, for example, Japanese Patent Laid- Open No. 6-186769).

If the transfer paper suggested so as to form a color image or transfer paper which has been used in a white and black electrophotographic method is used in the double side copying operation of a copying machine using the full color electrophotographic method, a fact has been detected that a critical problem arises in the traveling characteristic, and more particularly in the traveling characteristic in a low temperature and low humidity state.

SUMMARY OF THE INVENTION

Accordingly, an object of the present invention is to provide a double-side and full color transfer paper for electrophotography having excellent traveling characteristic when a double-side copying operation is performed by a full color copying machine or a printer, and more particularly having excellent traveling characteristic in a low temperature and low humidity state.

According to the present-invention, there is provided a (1) A double-sideA and full color transfer paper for electrophotography comprising a paper layer divided into a felt side and a wire side, wherein the difference between the orientation of fiber in the felt side and that in the wire side of the paper layer is 0.1 to −0.1, and both of residual curvature of the transfer paper in a MD (in a movement direction of a paper machine) and that in a CD (in a direction perpendicular to the MD) are included in a range from 7 to −7 $m^{-1}$, and (2) a double-side and full color transfer paper for electrophotography according to (1), wherein the expansion ratio of the transfer paper in the CD is 0.55 or lower.

The above and other objects and features of the present invention will be more apparent from the following description taken in conjunction with the accompanying drawings.

DETAILED DESCRIPTION OF THE PREFERRED EMBODIMENTS

Inventors of the present invention have researched and developed for the purpose of improving the unsatisfactory traveling characteristic when the double-side full copying operation is performed, in particular, improving the unsatisfactory traveling characteristic in a low temperature and low humidity state.

Figure 1:
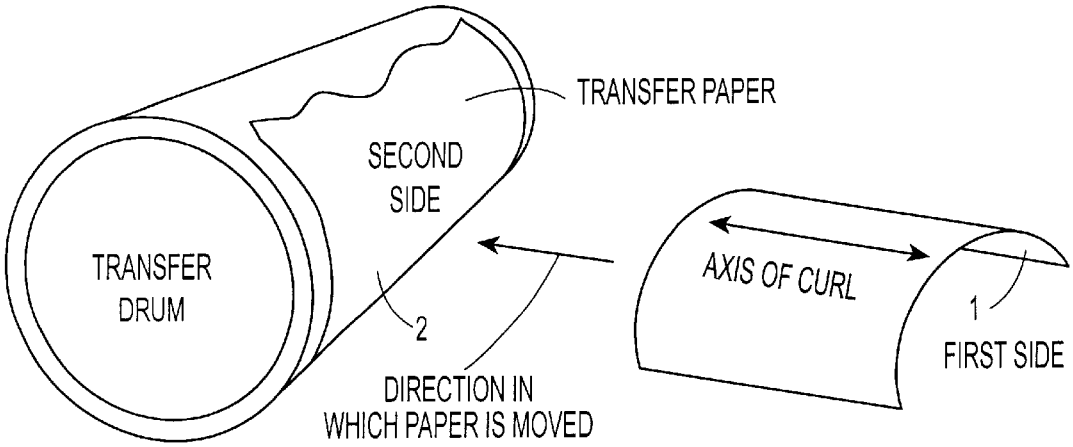
FIG. 1 is a schematic view showing a state where a transfer drum absorbs a curled paper which has been copied.

The unsatisfactory traveling characteristic is usually caused from the influence from the transference mechanism peculiar to the color copying machine such that when the transfer paper is curled, and in particular, when a curl axis is generated in parallel to a direction in which the transfer paper is moved as shown in FIG. 1, the leading end of the transfer paper cannot sufficiently be adsorbed by a transfer film. As a result, the transfer paper is brought into contact with a member in the apparatus and paper jam (a state in which the paper is deformed in the copying machine or the printer and the paper cannot be moved in the same) takes place. If the temperature and humidity are low, the stiffness of the paper is raised. Thus, an excessive curl is formed which causes the paper jam to take place.

To solve the foregoing problem, an attempt was performed such that the characteristic of the paper was controlled to make the axis of a formed curl to be perpendicular to the direction in which the transfer paper is moved. However, since the transfer paper is moved in both of the shorter side direction and the longer side direction, the axis of the curl of the copied paper cannot easily be controlled to always run parallel- to the moving direction even if various known means are used.

Moreover, the inventors of the present invention energetically investigated improving means, thus resulting in that a fact being detected such that the axis of the curl of the copied paper is formed in parallel to the shaft of a thermal fixing roll if a residual curvature in a certain condition of the transfer paper is included in a specific range. In addition, another fact was found that the axis of the curl is changed to the parallel direction by external force even if it is apparently formed in the perpendicular direction. That is, by making both of residual curvature of the transfer paper in a MD (in a movement direction of a paper machine) and that in a CD (in a direction perpendicular to the MD) to be included in a range from 7 to $-7\ m^{-1}$, the axis of the curl can satisfactorily be maintained.

Further development and research have resulted in a fact being detected in that the axis of the curl cannot be maintained satisfactorily depending upon the side of the transfer paper onto which an image is copied in a case where the orientation ratio in the felt side paper layer and that in the wire side of the same obtained by dividing the transfer paper are considerably different from each other even if the foregoing residual curvature is satisfactory. Therefore, to use the transfer paper regardless of the side of the same on which an image is formed, the difference between the orientation of fiber in the felt side and that in the wire side realized by dividing the transfer paper is adjusted to 0.1 to −0.1 and the expansion ratio in the CD is maintained to be 0.55 or less in a state where the residual curvature and the difference between the orientation of fiber in the felt side and that in the wire side are satisfied so that the size of the curl formed after an image has been copied onto the first side is reduced. Thus, the traveling characteristic of the second side can be improved. As a result, the present invention was established.

The difference between the orientation of fiber in the felt side and that in the wire side according to the present invention is measured by the following method: a sample is obtained by dividing the transfer paper into a felt-surface (FS) side paper layer and a wire surface (WS) side paper layer in such a manner that the basis weight of the transfer paper is made to be substantially the same (the basis weight ×0.5 ±basis weight ×0.1). The difference is calculated from the following equation:

(difference between the orientation of fiber in the felt side and that in the wire side)=(fiber orientation ratio in the felt surface layer)−(fiber orientation ratio in the wire surface layer)

Note that the fiber orientation ratio can be expressed by the following equation:

(fiber orientation ratio=propagation velocity ratio of longitudinal wave of ultrasonic wave)=(propagation velocity of ultrasonic wave in MD)/(propagation velocity of ultrasonic wave in CD)

Figure 2:
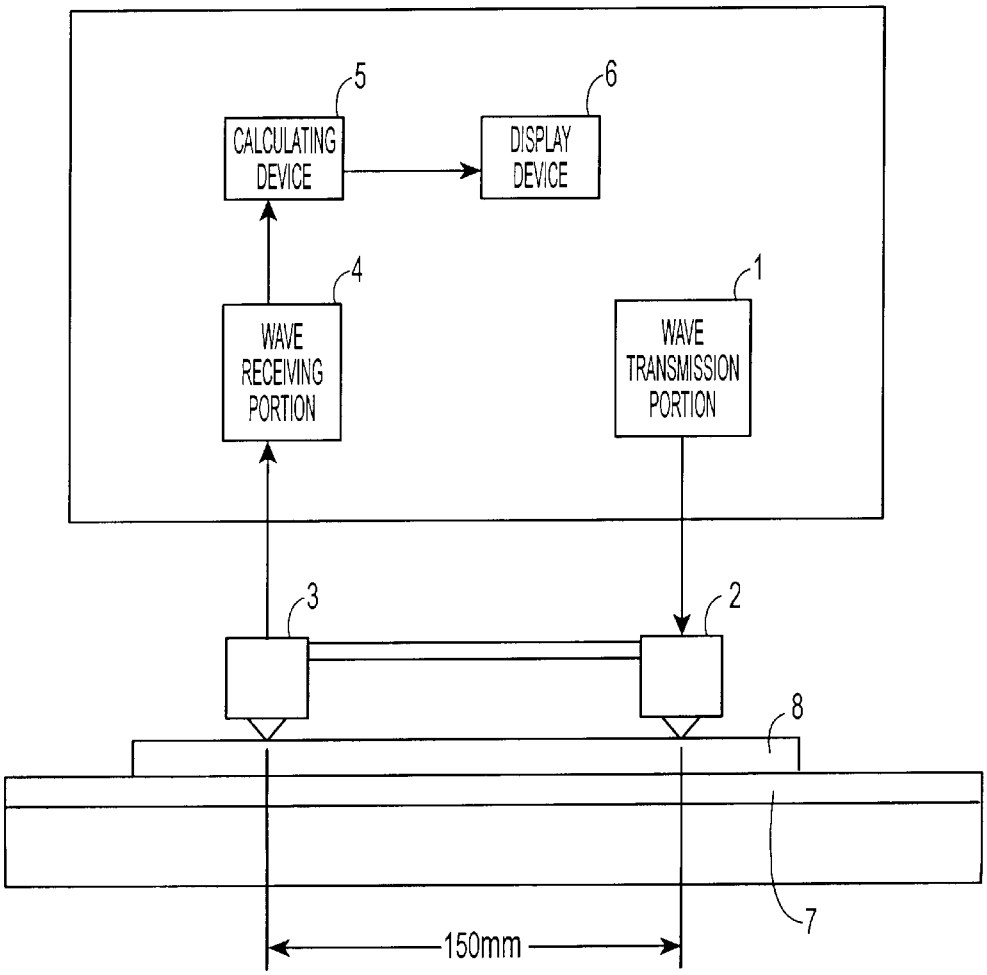
FIG. 2 is a block diagram showing a method of measuring the difference between the orientation of fiber in the felt side and that in the wire side.

The propagation velocity of the ultrasonic wave is obtained by a method shown in FIG. 2. A sample 8 is placed on a rubber plate 7 having a thickness of 10 mm and including air bubbles. A wave transmission oscillator 2 and a wave receiving oscillator 3 disposed apart from each other for a distance of 150 mm are brought into contact with the sample 8. In accordance with an instruction issued from a wave transmission portion 1, longitudinal waves are transmitted from the wave transmission oscillator 2 to be received by a wave receiving portion 4 through the wave receiving oscillator 3 so as to measure time taken from transmission from the wave transmission oscillator 2 to receipt of the longitudinal wave by the wave receiving oscillator 3 through the sample so as to be converted into propagation velocity. The propagation velocity in each of the MD and CD is measured so as to obtain the ratio of the propagation velocities which is used as the fiber orientation ratio. Referring to the drawing, reference numerals 5 represents a calculating device, and 6 represent a display device.

Figure 3:
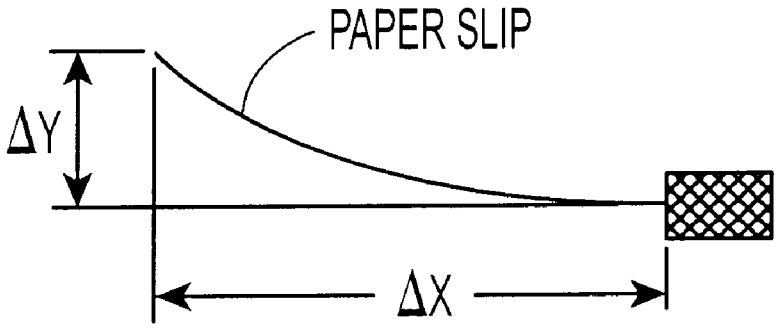
FIG. 3 is a diagram showing a method of calculating a residual curvature.
Figure 3:
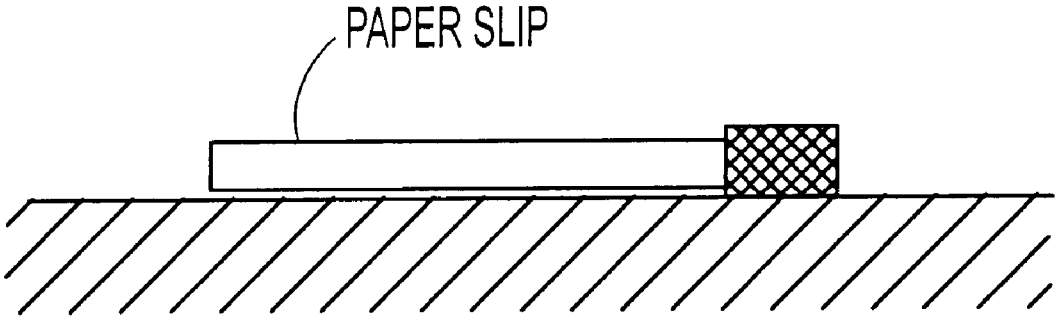

The residual curvature according to this embodiment is measured by the following method. Paper slips each having a width of 5 mm and a length of 100 mm are obtained from the MD and CD directions of the transfer paper. The paper slips are, as shown in FIG. 3, supported by a cantilever method by length of 50 mm. Then, three cycles of moisture absorption and desorption process are repeated such that the humidity is changed at 20° C. from 65% RH →80% RH →20% RH. Then, ΔX and ΔY of the curl are measured at the final cycle in a state where the humidity is 20% RH. The ΔX is the post-curl distance of the end of the paper slip away from the cantilever end of the paper slip to the cantilever end of the paper slip when projected on the pre-curl baseline length of the paper slip. The ΔY is the post-curl deflected distance of the end of the paper slip away from the cantilever end of the paper slip from the pre-curl baseline location of the paper slip. Then, curl curvature K20 is obtained from the following equation:

$$K20 = 2\Delta Y \times 1000/(\Delta X^2 + \Delta Y^2)$$

The obtained curl curvature is defined to be the residual curvature according to the present invention. If the sign is positive, a curl is formed such that the felt surface (FS) faces inside. If the sign is negative, a curl is formed such that the wire surface (WS) faces inside. The MD according to the present invention is a direction running parallel to the direction in which the paper machine moves, while the CD is a direction perpendicular to the movement direction.

The expansion ratio according to the present invention means a change ratio of the dimension obtained after the humidity has been changed from 65% RH →25% RH in the final cycle of three cycles of the moisture absorption and desorption process changing the humidity as 65% RH →25% RH →65% RH →90% RH at constant temperature, 20° C. Each sample for measuring the expansion ratio has a width of 50 mm and a length of 100 mm in the CD of the paper. The measurement is performed by using a geometric interchange type expansion meter such that tension which is substantially half the basis weight is applied.

The method of preventing the difference between the orientation of fiber in the felt side and that in the wire side according to the present invention is able to control it by adjusting the length of the grounding point (a J/W ratio) of a jet flow of pulp slurry on the wire and by changing the conditions, such as the dehydration, shaking, the degree of opening of the lip and the press part drawing conditions.

The method of controlling the residual curvature according to the present invention is able to control the residual curvature similarly to the method of preventing the difference between the orientation of fiber in the felt side and that in the wire side. Moreover, the residual curvature can be controlled by adjusting the difference in the drying temperature between the felt side and the wire side of wet paper in the drying process or by controlling the tension in the machine operation direction. In order to satisfy both of the difference between the orientation of fiber in the felt side and that in the wire side and the residual curvature, the paper machining conditions must sufficiently be optimized.

The method of reducing the CD expansion ratio according to the present invention can be realized by adjusting the mixing of dried pulp, such as LBKP, or by lowering the ratio of components having short fiber- lengths in the fiber length distribution or by lowering the fiber orientation ratio.

Pulp for use in the present invention may contain virgin chemical pulp (CP: pulp manufactured by chemically processing wood or another fiber material, for example, bleached kraft pulp of broad-leaved tree, bleached kraft pulp of needle-leaved tree, non-bleached kraft pulp of broad-leaved tree, non-bleached Kraft pulp of needle-leaved tree, bleached sulphite pulp of broad-leaved tree, bleached sulphite pulp of needle-leaved tree, non-bleached sulphite pulp of broad-leaved tree and non-bleached sulphite pump of needle-leaved tree); or virgin chemical pulp (MP: pulp manufactured by mechanically processing wood or another fiber material, for example, ground pulp, chemi-ground pulp, chemi-mechanical pulp and semichemical pulp). Moreover, the following materials can be obtained: pulp of waste paper obtained by dissociating non-printed waste paper, such as high-quality, special-quality, medium quality and unsatisfactory quality white paper, which is waste paper obtained as a result of cutting, as waste paper and residue from the width cutting work, woodfree paper, woodfree coat paper, medium-quality paper, medium-quality coat paper, plain paper obtainable in a book binding factory, a printing plant, a cutting factory or the like and printed by planographic printing, relief printing, intaglio printing, an electrophotographic method, a thermal printing method, a thermal transfer method, a pressure sensing recording method or an ink jet recording method or-with carbon paper, or written with water or oil based ink or a-pencil, and pulp obtained by deinking disassociated waste newspaper sheet (hereinafter abbreviated as "DIP" ). Moreover, pulp obtained by processing non-wool fiber, such as megass, kenaf, bamboo or rice straw, may be used.

As a filler which can be used in the transfer paper according to the present invention, an inorganic filler made of, for example, calcium carbonate, such as heavy calcium carbonate, light calcium carbonate and chalk and silic acid, such as kaolin, baked clay, pyrophyllite, sericite and talc, and an organic filler, such as urea resin can be employed. If the filler is added, it is preferable that it is added as an ash content (JIS-P-8128) by 5% or more in view of preventing set-off. If the ash content is larger than 23%, the quantity of generated paper dust can easily be enlarged. It is preferable that the quantity be smaller than the foregoing quantity.

When the transfer paper according to the present invention is coated, a variety of pigments for use general coat paper may be employed, for example, calcium carbonate, such as heavy calcium carbonate, light calcium carbonate, chalk and silicic acid, such as kaolin, baked clay, pyrophyllite, sericite and talc, and an organic filler, such as urea resin, can be employed or their mixture. It is preferable that pigment having a flat crystal shape or a shape formed by stacking flat crystal be contained by 60% or less of the total quantity of the pigment.

An adhesive agent for use when paper is coated may be water soluble adhesive agent, emulsion or latex having large adhesive force with the base or an additive, such as the pigment and restrained blocking characteristic, or their mixture. For example, water soluble resin, such as polyvinyl alcohol, denatured polyvinyl alcohol, starch, gelatin, casein, methylcellulose, hydroxycellulose, amide acrylate, ester acrylate copolymer, acrylic emulsion, vinyl acetate emulsion, vinylidene chloride emulsion, and polyester emulsion may be employed. Note that the present invention is not limited to the foregoing materials.

As a coating method, for example, an on-machine coater having a coating unit, such as gate roll coating unit or a sizing press coating unit, or an off-machine coater, such as a blade coating unit, an air knife coating unit, a roll coating unit, a bar coating unit, a reverse roll unit, a gravure coating unit or a curtain coating unit may be employed.

A sizing material to be contained in the present invention may be a rosin type sizing material, a synthetic sizing material, a petroleum resin sizing material or a neutral sizing material. It is combined with an adequate fixing material for the sizing material and the fiber, for example, aluminum sulfate or cation form starch. It is preferable that the neutral sizing material be employed to improve the traveling characteristic in the electrophotographic copying machine or the printer and the -preservability of the copied paper.

In order to realize adaptability to the electrophotographic operation including the copying adaptability and the traveling characteristic, the materials are adjusted and the manufacturing conditions are controlled.

In order to prevent disorder of an image and maintain an adequate density of a copied image, an electroconductive material, such as sodium chloride, potassium chloride, styrene-maleic acid copolymer or quaternary ammonia salt, is applied to the surface by a sizing press of the paper machine to make the electrical resistance ratio (JIS-K6911) of the transfer paper to be $10^9$ to $10^{11}$ Ω (at temperature of 20° C. and humidity of 65% RH). In order to reduce the quantity of paper dust which will be generated, a preferred adaptability can be obtained by coating the surface with PVA by a sizing press.

In order to improve the sharpness of the copied image, the rough surface is prevented by a calender process or the like to make the smoothness (JIS P 8119) of the transfer paper to be 50 seconds or more, preferably 60 seconds or more. The content of water after the package has been opened is adjusted to be a proper quantity of 4.0 to 6.0% in order to prevent waviness and to maintain required electric characteristic by using a drier process, a calender process or a cutting process of the paper machine. In addition, the brightness is made to be 80% or more. In order to prevent moisture absorption and desorption during reservation, the product is wrapped with a moisture-proofing paper or polypropylene film.

Examples

Examples of the present invention will now be described. Note that the present invention is not limited to the descriptions of the examples.

Example 1

Kraft pulp of broad-leaved tree (LBKP) decomposed by striking to a freeness of 450 ml C.S.F (Canadian Standard Freeness) was employed as the raw material pulp for making paper. Then, the following chemicals and fillers for making paper were added by the bone dry weight with respect to the weight of the pulp as follows:

| | |
|---|---|
| alkenyl succinic anhydride (ASA) (Fibran 81 manufactured by National Starch & Chemical) | 0.1% |
| Cationic Starch (Cato F manufactured by National Starch & Chemical) | 0.5% |
| light calcium carbonate | 15% |

The foregoing raw materials were used to make paper by a Fourdrinier paper machine, and then oxidized starch in a quantity of 0.9 g/m$^2$ and NaCl in a quantity of 0.1 g/m$^2$ were applied in a size pressing step. Then, the paper was allowed to pass through a machine calender so that the transfer paper having a basis weight of 81 g/m$^2$ and according to Example 1 was obtained.

The difference between the orientation of fiber in the felt side and that in the wire side and the residual curvature were controlled by changing the J/W ratio, the draw of the pressing part and the temperature of the upper and lower dryers of a multi-cylinder drier.

The obtained transfer paper had a difference between the orientation of fiber in the felt side and that in the wire side of 0.02, a residual curvature in CD of 2 m$^{-1}$, a residual curvature in MD of - 1 m$^{-1}$, an expansion ratio in CD of 0.51%. Results of the evaluation of the traveling characteristic of the second side in low temperature and low humidity environment (10° C. and 30% RH) are shown in Table 1.

The difference between the orientation of fiber in the felt side and that in the wire side was measured by a measuring apparatus (SONIC SHEET TESTER-210) manufactured by Nomura Shoji and calculated from the fiber orientation ratio.

The trouble ratio during running of the second side (quality defects, such as paper jam, defective paper feeding and folding of paper) was confirmed in an environment at 10° C. and 30% RH by the following procedure. A color copying machine was A-Color 935 (manufactured by Fuji Xerox) and three types of original documents (a color portrait, a color document including characters, a bar graph and a circle graph, and a white and black document containing 800 characters) for the first and second sides were combined (9 types).

A4-size sheets were used in the evaluation (in the longitudinal direction) and the paper was supplied in the short-side direction and the long-side direction. The first copying operation was performed on the felt surface (FS) and the wire surface (WS). Each of the nine combinations was allowed to run by 25 sheets (total: 900). The generation ratio was calculated for each of the felt surface (FS), the wire surface (WS) and total (TOTAL) from the number of generation of quality defects, such as paper jam and folding of paper. Results are shown in Table 1 as a trouble ratio during running.

Example 2

A similar operation to that according to Example 1 was performed except for a process in which the mixture ratio of calcium carbonate was enlarged to 20% and alkyl ketene dimer (ARD) (Size Pine K-903 manufactured by Arakawa Kogyo) was substituted for alkenyl succinic anhydride (ASA). Thus, transfer paper having a basis weight of 81 g/m$^2$ and according to Example 2 was obtained.

The difference between the orientation of fiber in the felt side and that in the wire side and the residual curvature were controlled by changing the J/W ratio, the draw of the pressing part and the temperature of the upper and lower dryers of a multi-cylinder drier.

The obtained transfer paper had a difference between the orientation of fiber in the felt side and that in the wire side of −0.10, a residual curvature in CD of −7 m$^{-1}$, a residual curvature in MD of 7 m$^{-1}$, an expansion ratio in CD of 0.45%. An evaluation similar to that according to Example 1 was performed. Results are shown in Table 1.

Example 3

The raw materials for paper were adjusted similarly to Example 1 so that base paper having a basis weight of 82 g/m$^2$ was obtained. Then, 0.05 part by weight of a dispersant (polyphosphate soda) was dissolved in 100 parts by weight of water, and then 80 parts by weight of cubic light calcium carbonate having an average particle size of 2 $\mu$m and 20 parts by weight of kaoline were dispersed. Then, 15 parts by weight of SBR and 5 parts by weight of PVA were, as binders, mixed in the pigment dispersed solution so that coating was obtained. The obtained coating was applied to both sides of the base paper by a coater to make the weight to be 4 g/m$^2$, followed by drying the base paper. Then, a calender process was performed so that transfer paper having a basis weight of 90 g/m$^2$ and according to Example 3 was obtained.

The difference between the orientation of fiber in the felt side and that in the wire side and the residual curvature were controlled by changing the J/W ratio, the draw of the pressing part and the temperature of the upper and lower dryers of a multi-cylinder drier.

The obtained transfer paper had a difference between the orientation of fiber in the-felt side and that in the wire side of 0.00, a residual curvature in CD of 1 m$^{-1}$, a residual curvature in MD of 2 m$^{-1}$, an expansion ratio in CD of 0.47%. An evaluation similar to that according to Example 1 was performed. Results are shown in Table 1.

Example 4

A similar operation to that according to Example 1 was performed except for a process in which the mixture ratio of calcium carbonate was reduced to 10% and neutral rosin size (KS767 manufactured by Arakawa Kogyo) was substituted for alkenyl succinic anhydride (ASA). Thus, transfer paper having a basis weight of 90 g/m$^2$ and according to Example 4 was obtained.

The difference between the orientation of fiber in the felt side and that in the wire side and the residual curvature were controlled by changing the JIW ratio, the draw of the pressing part and the temperature of the upper and lower dryers of a multi-cylinder drier.

The obtained transfer paper had a difference between the orientation of fiber in the felt side and that in the wire side of 0.02, a residual curvature in CD of 5 m$^{-1}$, a residual curvature in MD of −2 m$^{-1}$, an expansion ratio in CD of 0.55%. An evaluation similar to that according to Example 1 was performed. Results are shown in Table 1.

Example 5

The raw materials for paper were adjusted similarly to Example 2 so that transfer paper having a basis weight of 90 g/m2 according to Example 5 was obtained.

The difference between the orientation of fiber in the felt side and that in the wire side and the residual curvature were controlled by changing the J/W ratio, the draw of the pressing part and the temperature of the upper and lower dryers of a multi-cylinder drier.

The obtained transfer paper had a difference between the orientation of fiber in the felt side and that in the wire side of −0.05, a residual curvature in CD of −6 $m^{-1}$, a residual curvature in MD of 3 $m^{-1}$, an expansion ratio in CD of 0.49%. An evaluation similar to that according to Example 1 was performed. Results are shown in Table 1.

Example 6

The raw materials for paper were adjusted similarly to Example 1 so that base paper having a basis weight of 94 $g/m^2$ was obtained. Similarly to Example 3, the coating was adjusted, the coating was applied to both sides of the base paper in a quantity of 5 $g/m^2$ for each side, the base paper was dried and subjected to a calender process so that transfer paper having a basis weight of 104 $g/m^2$ according to Example 6 was obtained.

The difference between the orientation of fiber in the felt side and that in the wire side and the residual curvature were controlled by changing the J/W ratio, the draw of the pressing part and the temperature of the upper and lower dryers of a multi-cylinder drier.

The obtained transfer paper had a difference between the orientation of fiber in the felt side and that in the wire side of −0.01, a residual curvature in CD of −2 $m^{-1}$, a residual curvature in MD of 5 $m^{-1}$, an expansion ratio in CD of 0.54%. An evaluation similar to that according to Example 1 was performed. Results are shown in Table 1.

Example 7

The raw materials for paper were adjusted similarly to Example 1 except for that the mixture ratio of ASA was enlarged from 0.1% to 0.15% so that transfer paper having a basis weight of 104 $g/m^2$according to Example 7 was obtained.

The difference between the orientation of fiber in the felt side and that in the wire side and the residual curvature were controlled by changing the J/W ratio, the draw of the pressing part and the temperature of the upper and lower dryers of a multi-cylinder drier.

The obtained transfer paper had a difference between the orientation of fiber in the felt side and that in the wire side of −0.05, a residual curvature in CD of −2 $m^{-1}$, a residual curvature in MD of 3 $m^{-1}$, an expansion ratio in CD of 0.41%. An evaluation similar to that according to Example 1 was performed. Results are shown in Table 1.

Example 8

The raw materials for paper were adjusted, paper was made by a twin wire paper, and the paper was allowed the pass through a sizing press and a machine calender so that transfer paper having a basis weight of 104 $g/^2$ and according to Example 8 was obtained.

The difference between the orientation of fiber in the felt side and that in the wire side and the residual curvature were controlled by changing the J/W ratio, the draw of the pressing part and the temperature of the upper and lower dryers of a multi-cylinder drier.

The obtained transfer paper had a difference between the orientation of fiber in the felt side and that in the wire side of 0.10, a residual curvature in CD of 7 $m^{-1}$, a residual curvature in MD of −6 $m^{-1}$, an expansion ratio in CD of 0.50%. An evaluation similar to that according to Example 1 was performed. Results are shown in Table 1.

TABLE 1

| | 1 | 2 | 3 | 4 | 5 | 6 | 7 | 8 |
|---|---|---|---|---|---|---|---|---|
| Basis weight g/m2 | 81 | 81 | 90 | 90 | 90 | 104 | 104 | 104 |
| Difference between the orientation of fiber in the felt side and that in the wire side | 0.02 | −0.10 | 0.00 | 0.02 | −0.05 | −0.01 | −0.05 | 0.10 |
| Residual curvature in CD $m^{-1}$ | 2 | −7 | 1 | 5 | −6 | −2 | −2 | 7 |
| Residual curvature in MD $m^{-1}$ | −1 | 7 | 2 | −2 | 3 | 5 | 3 | −6 |
| Expansion ratio in CD % | 0.51 | 0.45 | 0.47 | 0.55 | 0.49 | 0.54 | 0.41 | 0.50 |
| Trouble ratio during running of second side % | | | | | | | | |
| Copy of 1st Side FS | less than 0.5 | less than 0.5 | less than 0.5 | 0.5 to less than 1 | less than 0.5 | 0.5 to less than 1 | less than 0.5 | 0.5 to less than 1 |
| Copy of 1st Side WS | less than 0.5 | less than 0.5 | less than 0.5 | less than 0.5 | less than 0.5 | less than 0.5 | less than 0.5 | less than 0.5 |
| Total | less than 0.5 | less than 0.5 | less than 0.5 | less than 0.5 | less than 0.5 | less than 0.5 | less than 0.5 | less than 0.5 |

Comparative Example 1

Similarly to Example 1, the raw materials for paper were adjusted, paper was made by the Fourdrinier paper machine, and the paper was allowed to pass through the sizing press and the machine calender so that transfer paper having a basis weight of 81 $g/m^2$ and according to Comparative Example 1 was obtained. However, the difference between the orientation of fiber in the felt side and that in the wire side and the residual curvature were not controlled.

The obtained transfer paper was evaluated similarly to Example 1. Results are shown in Table 2.

Comparative Example 2

Similarly to Example 2, the raw materials for paper were adjusted, paper was made by the Fourdrinier paper machine, and the paper was allowed to pass through the sizing press and the machine calender so that transfer paper having a basis weight of 81 $g/m^2$ and according to Comparative Example 2 was obtained. However, the difference between the orientation of fiber in the felt side and that in the wire side and the residual curvature were not controlled.

The obtained transfer paper was evaluated similarly to Example 1. Results are shown in Table 2.

Comparative Example 3

Similarly to Example 3, the raw materials for paper were adjusted, paper was made by the Fourdrinier paper machine, and the paper was allowed to pass through the sizing press and the machine calender. The obtained base paper was coated similarly to Example 3 so that transfer paper having a basis weight of 90 g/m$^2$ and according to Comparative Example 3 was obtained. However, the difference between the orientation of fiber in the felt side and that in the wire side and the residual curvature were not controlled.

The obtained transfer paper was evaluated similarly to Example 1. Results are shown in Table 2.

Comparative Example 4

Similarly to Example 4, the raw materials for paper were adjusted, paper was made by the Fourdrinier paper machine, and the paper was allowed to pass through the sizing press and the machine calender so that transfer paper having a basis weight of 90 g/m$^2$ and according to Comparative Example 4 was obtained. However, the difference between the orientation of fiber in the felt side and that in the wire side and the residual curvature were not controlled.

The obtained transfer paper was evaluated similarly to Example 1. Results are shown in Table 2.

Comparative Example 5

Similarly to Example 5, the raw materials for paper were adjusted, paper was made by the Fourdrinier paper machine, and the paper was allowed to pass through the sizing press and the machine calender so that transfer paper having a basis weight of 90 g/m$^2$ and according to Comparative Example 5 was obtained. However, the difference between the orientation of fiber in the felt side and that in the wire side and the residual curvature were not controlled.

The obtained transfer paper was evaluated similarly to Example 1. Results are shown in Table 2.

Comparative Example 6

Similarly to Example 6, the raw materials for paper were adjusted, paper was made by the Fourdrinier paper machine, and the paper was allowed to pass through the sizing press and the machine calender. The obtained base paper was coated similarly to Example 6 so that transfer paper having a basis weight of 104 g/m$^2$ and according to Comparative Example 6 was obtained. However, the difference between the orientation of fiber in the felt side and that in the wire side and the residual curvature were not controlled.

The obtained transfer paper was evaluated similarly to Example 1. Results are shown in Table 2.

Comparative Example 7

Similarly to Example 7, the raw materials for paper were adjusted, paper was made by the Fourdrinier paper machine, and the paper was allowed to pass through the sizing press and the machine calender so that transfer paper having a basis weight of 104 g/m$^2$ and according to Comparative Example 7 was obtained. However, the difference between the orientation of fiber in the felt side and that in the wire side and the residual curvature were not controlled.

The obtained transfer paper was evaluated similarly to Example 1. Results are shown in Table 2.

Comparative Example 8

Similarly to Example 8, the raw materials for paper were adjusted, paper was made by the twin wire paper machine, and the paper was allowed to pass through the sizing press and the machine calender so that transfer paper having a basis weight of 104 g/m$^2$ and according-to Comparative Example 8 was obtained. However, the difference between the orientation of fiber in the felt side and that in the wire side and the residual curvature were not controlled.

The obtained transfer paper was evaluated similarly to Example 1. Results are shown in Table 2.

TABLE 2

| | 1 | 2 | 3 | 4 | 5 | 6 | 7 | 8 |
|---|---|---|---|---|---|---|---|---|
| Basis weight g/m2 | 81 | 81 | 90 | 90 | 90 | 104 | 104 | 104 |
| Difference between the orientation of fiber in the felt side and that in the wire side | 0.02 | −0.17 | −0.15 | 0.05 | −0.17 | −0.15 | +0.10 | 0.12 |
| Residual curvature in CD m$^1$ | 3 | −10 | −6 | 8 | −8 | −6 | 9 | 12 |
| Residual curvature in MD m$^1$ | −8 | 5 | 12 | −9 | 7 | 8 | −10 | −6 |
| Expansion ratio in CD % | 0.58 | 0.45 | 0.60 | 0.58 | 0.44 | 0.54 | 0.59 | 0.55 |
| Trouble ratio during running of second side % | | | | | | | | |
| Copy of 1st Side FS | 3 to less than 5 | 3 to less than 5 | 5 or more | 1 to less than 3 | less than 1 | 5 or more | 5 or more | 5 or more |
| Copy of 1st Side WS | 1 to less than 3 | 5 or more | 3 to less than 5 | 1 to less than 3 | 3 to less than 5 | 3 to less than 5 | 3 to less than 5 | less than 1 |
| Total | 1 to less than 3 | 5 or more | 5 or more | less than 0.5 | less than 0.5 | less than 0.5 | less than 0.5 | less than 0.5 |

Since the present invention employs the above-mentioned structure, transfer paper free from trouble during running of the second side and exhibiting excellent double-side traveling characteristic in a full color copying machine can be provided.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. Electrophotographic transfer paper for duplex color transfer, the paper having a felt side and a wire side, the paper not having a coating layer, wherein a fiber orientation ratio for each of the felt side and the wire side is determined using an ultrasonic propagation method, wherein a difference between the orientation of fiber in the felt side and the orientation of fiber in the wire side is in the range of 0.1 to −0.1, wherein the residual curvature of the paper in both the MD and the CD direction is in the range 7 to $-7m^{-1}$ where MD represents a paper direction parallel to the direction of movement of a paper machine, and CD represents a paper direction perpendicular to the MD, and wherein an expansion ratio of the paper in the CD direction is 0.55 or less.

2. A method of forming an image on an electrophotographic transfer paper, comprising transferring an image using a color copying machine onto an electrophotographic transfer paper for duplex color transfer, the paper having a felt side and a wire side, wherein a fiber orientation ratio for each of the felt side and the wire side is determined using an ultrasonic propagation method, wherein a difference between the orientation of fiber in the felt side and the orientation of fiber in the wire side is in the range of 0.1 to −0.1, wherein the residual curvature of the paper in both the MD and the CD direction is in the range 7 to $-7\ m^{-1}$ where MD represents a paper direction parallel to the direction of movement of a paper machine, and CD represents a paper direction perpendicular to the MD, and wherein an expansion ratio of the paper in the CD direction is 0.55 or less.

3. The method of claim 2, wherein the transfer paper does not have a coated layer.

4.The method of claim 2, wherein an axis of a formed curl in the paper during the transfer step is in the CD direction.

* * * * *